US011291243B2

(12) United States Patent
Kadiric et al.

(10) Patent No.: US 11,291,243 B2
(45) Date of Patent: Apr. 5, 2022

(54) AEROSOL GENERATING ARTICLE HAVING WATER DISPERSIBLE FILTER COMPONENT

(71) Applicant: PHILIP MORRIS PRODUCTS S.A., Neuchatel (CH)

(72) Inventors: Alen Kadiric, Orpund (CH); Stefanos Papakyrillou, Cortaillod (CH)

(73) Assignee: Philip Morris Products S.A., Neuchatel (CH)

( * ) Notice: Subject to any disclaimer, the term of this patent is extended or adjusted under 35 U.S.C. 154(b) by 342 days.

(21) Appl. No.: 16/471,033

(22) PCT Filed: Dec. 21, 2017

(86) PCT No.: PCT/EP2017/084184

§ 371 (c)(1),
(2) Date: Jun. 19, 2019

(87) PCT Pub. No.: WO2018/122115

PCT Pub. Date: Jul. 5, 2018

(65) Prior Publication Data

US 2019/0313691 A1 Oct. 17, 2019

(30) Foreign Application Priority Data

Dec. 29, 2016 (EP) ..... 16207310

(51) Int. Cl.

| | |
|---|---|
| ***A24D 3/06*** | (2006.01) |
| ***A24D 1/02*** | (2006.01) |
| ***A24D 3/10*** | (2006.01) |

(52) U.S. Cl.

CPC ..... *A24D 3/068* (2013.01); *A24D 1/025* (2013.01); *A24D 3/063* (2013.01); *A24D 3/10* (2013.01)

(58) Field of Classification Search

None

See application file for complete search history.

(56) References Cited

U.S. PATENT DOCUMENTS

| | | | |
|---|---|---|---|
| 4,893,638 | A | 1/1990 | Lauterbach |
| 5,709,227 | A | 1/1998 | Arzonico |

(Continued)

FOREIGN PATENT DOCUMENTS

| | | |
|---|---|---|
| CN | 102080275 | 6/2011 |
| CN | 104244747 | 12/2014 |

(Continued)

OTHER PUBLICATIONS

PCT Search Report and Written Opinion for PCT/EP2017/084184 filed Dec. 21, 2017 (10 pages).

(Continued)

*Primary Examiner* — Dennis R Cordray

(74) *Attorney, Agent, or Firm* — Mueting Raasch Group

(57) ABSTRACT

An aerosol generating article (10) comprises: an aerosol generating substrate (12); a filter (14) in axial alignment with the aerosol generating substrate, the filter (14) comprising at least one water dispersible filter component (16), wherein the filter component is water dispersible under the test conditions of EN 14987:2006; and a tipping wrapper (20) wrapped around the filter (14) and at least a portion of the aerosol generating substrate (12). The tipping wrapper (20) comprises: a first weakening line (22) extending around at least a portion of the tipping wrapper (20); a removable tipping wrapper portion (26) extending downstream from the at least one weakening line (22) and at least partially overlying the water dispersible filter component (16); and an upstream tipping wrapper portion (24) extending upstream from the first weakening line (22), wherein the upstream tipping wrapper portion (24) is attached to a downstream (Continued)

portion of the aerosol generating substrate (12) and an upstream portion of the filter (14).

16 Claims, 1 Drawing Sheet

(56) References Cited

U.S. PATENT DOCUMENTS

| | | | | |
|---|---|---|---|---|
| 8,613,284 | B2 * | 12/2013 | Hutchens | A24D 3/068 131/341 |
| 10,292,421 | B2 | 5/2019 | Nappi | |
| 10,602,770 | B2 | 3/2020 | Camus | |
| 2008/0029111 | A1 | 2/2008 | Dube | |
| 2008/0314399 | A1 | 12/2008 | Ricketts | |
| 2011/0180088 | A1 | 7/2011 | Hooper | |
| 2012/0000481 | A1 | 1/2012 | Potter | |
| 2012/0325232 | A1 | 12/2012 | Yokogawa | |
| 2015/0059789 | A1 * | 3/2015 | Mccormack | A24D 3/04 131/335 |
| 2015/0164134 | A1 * | 6/2015 | Taniguchi | A24D 3/068 131/332 |
| 2015/0173414 | A1 | 6/2015 | Bachmann | |
| 2015/0374030 | A1 * | 12/2015 | Lisauskas | A24D 3/068 131/345 |
| 2017/0280766 | A1 * | 10/2017 | Besso | D21H 23/52 |
| 2019/0239558 | A1 * | 8/2019 | Ono | A24D 3/063 |

FOREIGN PATENT DOCUMENTS

| | | | |
|---|---|---|---|
| CN | 105792684 | | 7/2016 |
| EP | 2002737 | | 12/2008 |
| EP | 2862456 | | 4/2015 |
| EP | 2888955 | | 7/2015 |
| EP | 2888958 | | 7/2015 |
| JP | 2015-536154 | | 12/2015 |
| RU | 2517611 | | 5/2014 |
| SU | 1829918 | | 12/1989 |
| WO | WO 95/23527 | | 9/1995 |
| WO | WO 2011/077141 | | 6/2011 |
| WO | WO 2012/166302 | | 12/2012 |
| WO | WO 2013/011301 | | 1/2013 |
| WO | WO 2013/174975 | | 11/2013 |
| WO | WO 2013/186938 | | 12/2013 |
| WO | WO 2014/009499 | | 1/2014 |
| WO | WO 2015/014999 | | 2/2015 |
| WO | WO 2016/063182 | | 4/2016 |
| WO | WO 2016/156209 | A1 * | 10/2016 |
| WO | WO 2016/156219 | | 10/2016 |
| WO | WO 2016/188649 | | 12/2016 |
| WO | WO 2018/060141 | | 4/2018 |

OTHER PUBLICATIONS

Office Action issued in China for Application No. 201780075244.8 dated May 7, 2021 (20 pages). English translation included.
Office Action issued in Russia for Application No. 2019123432 dated Apr. 21, 2021 (18 pages). English translation included.
Office Action issued in Japan for Application No. 2019-529887 dated Dec. 20, 2021 (11 pages). English translation included.

* cited by examiner

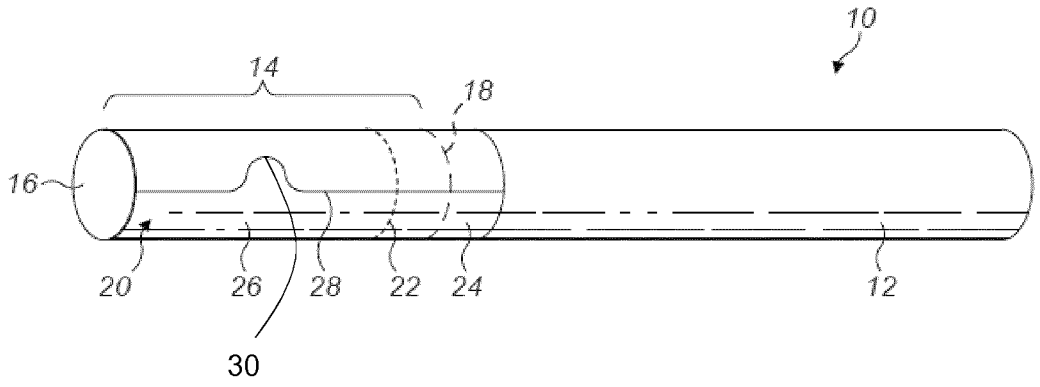
10
14
18
16
20
26
28
22
24
12
30

AEROSOL GENERATING ARTICLE HAVING WATER DISPERSIBLE FILTER COMPONENT

This application is a U.S. National Stage Application of International Application No. PCT/EP2017/084184 filed Dec. 21, 2017, which was published in English on Jul. 5, 2018, as International Publication No. WO 2018/122115 A1. International Application No. PCT/EP2017/084184 claims priority to European Application No. 16207310.0 filed Dec. 29, 2016.

The present invention relates to an aerosol generating article comprising a filter with increased water dispersibility.

Filter cigarettes typically comprise a cylindrical rod of tobacco cut filler surrounded by a paper wrapper and a cylindrical filter axially aligned in an abutting end-to-end relationship with the wrapped tobacco rod. The cylindrical filter typically comprises a filtration material circumscribed by a paper plug wrap. Conventionally, the wrapped tobacco rod and the filter are joined by a band of tipping wrapper that normally circumscribes the entire length of the filter and an adjacent portion of the wrapped tobacco rod. A conventional filter cigarette is typically smoked by lighting the end of the cigarette opposite the filter so that the tobacco rod burns.

A number of aerosol generating articles in which tobacco is heated rather than combusted have also been proposed in the art. In heated aerosol generating articles, an aerosol is generated by heating a flavour generating substrate, such as tobacco. Known heated aerosol generating articles include, for example, electrically heated aerosol generating articles and aerosol generating articles in which an aerosol is generated by the transfer of heat from a combustible fuel element or heat source to a physically separate aerosol forming material. During smoking, volatile compounds are released from the aerosol forming substrate by heat transfer from the fuel element and entrained in air drawn through the aerosol generating article. As the released compounds cool they condense to form an aerosol that is inhaled by the consumer. Also known are aerosol generating articles in which a nicotine-containing aerosol is generated from a tobacco material, tobacco extract, or other nicotine source, without combustion, and in some cases without heating, for example through a chemical reaction.

After an aerosol generating article has been smoked and discarded, it is desirable for the remaining filter section to break down as quickly as possible. It is known to use water dispersible or degradable materials to form filter materials; however whilst the filter remains intact with the tipping wrapper around the filter components, the filter materials cannot be fully exposed to moisture in the environment and therefore do not break down efficiently. The tipping wrapper therefore acts as a barrier between the filter materials and the environmental water, which slows down the breakdown of the filter.

It would be desirable to provide a novel aerosol generating article having a filter with an arrangement that enables the filter materials to disperse more efficiently in water, after the filter has been discarded. It would be particularly desirable to provide such an aerosol generating article that can be readily manufactured using existing high speed techniques and apparatus with minimal modifications.

According to the invention there is provided an aerosol generating article comprising: an aerosol generating substrate; a filter in axial alignment with the aerosol generating substrate, the filter comprising at least one water dispersible filter component, wherein the filter component is water dispersible under the test conditions of EN14987:2006; and a tipping wrapper wrapped around the filter and at least a portion of the aerosol generating substrate. The tipping wrapper comprises: a first weakening line extending around at least a portion of the tipping wrapper; a removable tipping wrapper portion extending downstream from the at least one weakening line and at least partially overlying the water dispersible filter component; and an upstream tipping wrapper portion extending upstream from the first weakening line, wherein the upstream tipping wrapper portion is attached to a downstream portion of the aerosol generating substrate and an upstream portion of the filter.

As used herein, the term "aerosol generating substrate" describes a substrate capable of releasing, upon heating (including combustion), volatile compounds, which can form an aerosol. The aerosol generated from aerosol generating substrates may be visible or invisible and may include vapours (for example, fine particles of substances, which are in a gaseous state, that are ordinarily liquid or solid at room temperature) as well as gases and liquid droplets of condensed vapours.

As used herein, the terms "upstream" and "downstream" describe the relative positions of elements, or portions of elements, of the aerosol generating article in relation to the direction in which a consumer draws on the aerosol generating article during use thereof. Aerosol generating articles as described herein comprise a downstream end (that is, the mouth end) and an opposed upstream end. In use, a consumer draws on the downstream end of the aerosol generating article. The downstream end is downstream of the upstream end, which may also be described as the distal end. The filter is downstream of the aerosol generating substrate.

As used herein, the term "longitudinal" refers to the direction corresponding to the longitudinal axis of the aerosol generating article or filter.

As used herein, the term "water dispersible" refers to a filter component formed of a material that physically breaks down or disintegrates when the material comes into contact with cold water. For the purposes of the present invention, a filter component is considered to be "water dispersible" if it produces a dispersible fraction of more than 90 percent after dissolution in cold water under the test conditions described in EN14987:2006. Under these test conditions, the filter component is placed in 1 litre of tap water under stirring conditions at 150 rpm in a 2 litre beaker. The test material is stirred for 16 hours at 25 degrees Celsius. After this period, the suspension is passed through a 10 mm sieve and the percentage of the material that is able to pass through the sieve is determined. This percentage corresponds to the "dispersible fraction" referred to above.

Conventional filters commonly incorporate one or more segments of cellulose acetate tow, which are not water dispersible according to the test described above since they typically have a dispersible fraction of less than 10 percent.

As defined above, the filter of aerosol generating articles according to the invention incorporates at least one water dispersible filter component, in combination with a removable tipping wrapper portion, which is intended to be removed by the consumer before the filter is discarded. The removal of the tipping wrapper portion exposes the underlying water dispersible filter component and allows the filter material forming the filter component to expand and potentially break apart. As a result, the filter material comes into contact with environmental moisture more quickly and over a potentially greater surface area. With the removable tipping wrapper portion removed from the filter, the tipping wrapper therefore no longer inhibits contact between the filter materials and environmental water, which increases the speed of dispersion of the filter materials. The physical breakdown of the filter materials as a result of the dispersion in water may additionally assist with any chemical degradation or biodegradation of the materials due to the increased exposure.

The filter of aerosol generating articles according to the invention may comprise one or more filter components which are water dispersible. The one or more water dispersible filter components may be combined with other filter components that are not water dispersible but preferably, the entire filter is water dispersible under the test conditions described above.

As described above, the dispersion of the filter component in water causes a physical breakdown of the filter materials. In some embodiments, the water dispersible filter component may additionally be degradable in water, such that the filter component chemically breaks down over time in the presence of water.

The water dispersible filter component may additionally be at least partially biodegradable. Preferably, the water dispersible filter component has a biodegradability in soil medium of at least about 45 percent when tested according to ISO 17556. The test is carried out on the water dispersible filter component with the removable tipping wrapper portion still in place on the filter. The water dispersible filter component therefore has a level of biodegradability in soil medium that is at least 10 percent higher than for a standard cellulose acetate tow segment, which typically has a biodegradability in soil medium of between about 30 and 35 percent.

Alternatively or in addition, the water dispersible filter component has a biodegradability in aqueous medium of at least 45 percent when tested according to ISO 14851. The test is carried out on the water dispersible filter component with the removable tipping wrapper portion still in place on the filter. The water dispersible filter component therefore has a level of biodegradability in aqueous medium that is at least 10 percent higher than for a standard cellulose acetate tow segment, which typically has a biodegradability in aqueous medium of between about 30 and 35 percent.

The water dispersible filter component of the filter of aerosol generating articles according to the invention is formed of water dispersible filter materials and may take various different forms.

Preferably, the filter of aerosol generating articles according to the invention comprises at least one filter component formed of a water dispersible sheet material. In certain preferred embodiments of the present invention, the water dispersible filter component comprises a plug formed of a water dispersible sheet material. The water dispersible sheet material may be gathered or convoluted to form the plug. Alternatively, the water dispersible sheet material may be cut or shredded to form strands which are then gathered together to form the plug.

Alternatively or in addition to the use of a plug formed of a water dispersible sheet material, as described above, the water dispersible filter component may comprise a wrapper formed of a water dispersible sheet material which circumscribes at least a portion of the filter. For example, the filter may comprise one or more plug wraps formed of a water dispersible sheet material.

Preferably, the water dispersible filter component comprises a plug formed of a water dispersible sheet material and circumscribed by a water dispersible plug wrap. This combination of water dispersible materials optimises the dispersibility of the filter component in water.

In any of the described embodiments comprising a filter component formed of a water dispersible sheet material, the water dispersible sheet material may comprise any suitable fibres combined with a water soluble binder. When the sheet material comes into contact with water, the water soluble binder dissolves and the fibres are able to disperse, which brings about disintegration of the sheet.

Preferably, the water dispersible sheet material comprises cellulosic fibres and a water soluble binder. For example, the water dispersible sheet material may comprise cellulose fibres such as wood pulp, cellulose ester fibres such as cellulose acetate fibres or a combination thereof. In one particularly preferred embodiment, the water dispersible sheet material comprises a combination of wood pulp fibres (cellulose fibres) and cellulose acetate fibres. The ratio of the wood pulp fibres to cellulose acetate fibres may be adjusted in order to modify the tensile strength of the water dispersible sheet material. Preferably, the ratio of the wood pulp fibres to the cellulose acetate fibres is between about 30:70 and about 90:10, more preferably between about 40:60 and about 70:30, most preferably about 50:50. These preferred ratios ensure that an acceptable tensile strength is retained whilst also optimising the degree of dispersibility. Suitable water dispersible sheet materials comprising a combination of wood pulp fibres and cellulose acetate fibres are described in EP-A-2862456.

In another preferred embodiment, the water dispersible sheet material comprises at least about 85 percent by weight wood pulp fibres, more preferably at least about 90 percent by weight and most preferably at least about 95 percent by weight. Preferably, the wood pulp fibres comprise long fibre pulp, mercerised pulp, or combinations thereof. In such embodiments, the wood pulp fibres will typically not be combined with cellulose ester fibres. Suitable water dispersible sheet materials comprising a high proportion of wood pulp fibres are described in US-A-2015/173414.

Suitable water soluble binders for forming sheet materials are known to the skilled person. In some preferred embodiments, the water soluble binder is a cellulosic binder. Particularly preferably, the water soluble binder comprises carboxymethyl cellulose (CMC), or a salt or derivative of CMC. For example, suitable sheet materials comprising CMC as a binder are described in US-A-2015/173414.

In other preferred embodiments, the water soluble binder comprises an alkali metal salt of a water soluble anionic polymer, such as a polysaccharide or polyacrylic acid. Particularly preferably, the water soluble binder comprises an alkali metal salt of carboxymethyl cellulose (CMC). For example, suitable water soluble binders are described in EP-A-2862456.

Preferably, the water dispersible sheet material comprises less than about 5 percent by weight of the water soluble binder, more preferably less than about 3 percent by weight and most preferably less than about 2 percent by weight.

Preferably, the water dispersible sheet material has a basis weight of between about 10 grams per square metre (gsm) and about 60 gsm, more preferably between about 15 gsm and about 45 gsm, most preferably between about 20 gsm and about 40 gsm.

Alternatively or in addition to a filter component formed of a water dispersible sheet material, the filter of the aerosol generating articles according to the invention may incorporate a water dispersible filter component comprising a fibrous tow segment formed of a plurality of fibres combined with a water soluble binder which acts as the plasticiser to hold the fibres together in the tow segment. Any of the water soluble binders described above in relation to the water dispersible sheet material would also be suitable for use in embodiments comprising a fibrous tow segment.

As with the water dispersible sheet material, the water soluble binder dissolves upon contact with water so that the fibres forming the fibrous tow segment are able to disperse, which brings about disintegration of the tow segment. The fibrous tow segment may be formed of any suitable fibres combined with the water soluble binder. For example, the fibrous tow segment may comprise cellulose fibres such as wood pulp fibres, cellulose acetate fibres, or a combination thereof.

As described above, aerosol generating articles according to the invention incorporate a modified tipping wrapper, which corresponds to the outer wrapper of the filter, circumscribing the filter and the downstream end of the aerosol generating substrate. The tipping wrapper includes an upstream tipping wrapper portion which attaches the downstream end of the aerosol generating substrate to the upstream end of the filter and which is intended to stay in place on the aerosol generating article after the removal of the removable tipping wrapper portion. The tipping wrapper further includes a downstream, removable tipping wrapper portion. Initially, the upstream tipping wrapper portion and the removable tipping wrapper portion are connected along the first weakening line and the tipping wrapper can be torn by the consumer along the first weakening line in order to remove the removable tipping wrapper portion. The removable tipping wrapper portion may be removed by the consumer prior to smoking, during smoking or after smoking, by breaking along the first weakening line in the tipping wrapper.

As described above, the incorporation of the removable tipping wrapper portion enables the tipping wrapper to be partially removed prior to the disposal of the filter in order to increase the efficiency of the dispersion in water of the underlying filter components.

The removal of at least a portion of the tipping wrapper of an aerosol generating article to expose a clean, underlying filter wrapper may also advantageously improve hygiene levels for the consumer. This may be particularly beneficial, for example, where aerosol generating articles have been transported or stored individually, rather than within a container. Furthermore, a removable tipping wrapper portion may be used to provide the consumer with the ability to change the sensory experience obtained during smoking. For example, the filter may be provided with a flavourant or other additive that is released upon removal of the removable tipping wrapper portion. In another example, the filter may be provided with additional ventilation which is uncovered when the removable tipping wrapper portion is removed.

The removable tipping wrapper portion is positioned such that it overlies at least a part of the water dispersible filter component. This ensures that the water dispersible filter component is exposed to the greatest extent possible upon removal of the removable tipping wrapper portion, in order to optimise the ability of the filter component to disperse upon contact with water.

The length of the removable tipping wrapper portion in the longitudinal direction of the aerosol generating article may be adjusted, for example, depending on the arrangement of the underlying filter components and any intended effects of the removal of the portion of the tipping wrapper during smoking. Preferably, the removable tipping wrapper portion extends at least 12 mm in a longitudinal direction along the filter in order to ensure that a sufficient area of the underlying water dispersible filter component is exposed when the removable tipping wrapper portion is removed.

In certain embodiments of the present invention, the removable tipping wrapper portion extends to the downstream end of the filter so that the entire tipping wrapper downstream of the first weakening line is removed to expose the underlying filter surface. This arrangement may be advantageous, for example, where the removable tipping wrapper portion is provided for the improvement of hygiene during smoking.

In alternative embodiments of the present invention, the tipping wrapper may further comprise a second weakening line spaced apart from the first weakening line in the downstream direction, wherein the removable tipping wrapper portion is defined between the first weakening line and the second weakening line. In such embodiments, the tipping wrapper preferably further comprises a downstream tipping wrapper portion extending downstream from the second weakening line and attached to a downstream portion of the filter. This arrangement may be preferable, for example, where a strip of the tipping wrapper is removable in order to expose an underlying additive or ventilation.

The first weakening line and the second weakening line (where present) may take any suitable form to provide a line of weakness in the tipping wrapper along which the tipping wrapper will preferentially tear. Preferably, each weakening line comprises multiple cuts spaced apart in a circumferential direction to form a row of perforations extending around the tipping wrapper. In such embodiments, the row of perforations preferably extends around substantially the entire circumference of the tipping wrapper. To aid the consumer in tearing the tipping wrapper along the row of perforations, the weakening line may comprise an elongate cut extending between an edge of the tipping wrapper at a tipping wrapper seam and the first perforation in the row of perforations.

Where a row perforations is provided, the row of perforations comprises uncut segments of tipping wrapper between consecutive perforations. The total length of the uncut segments preferably defines a percentage of hold of between about 15 percent and about 30 percent of the total length of the row of perforations, more preferably between about 18 percent and about 25 percent.

A "percentage of hold" for a row of perforations can be used as an indication of the strength of the row of perforations and is defined as:

$$\text{percentage of hold} = \frac{\text{total length of uncut segments}}{\text{total length of uncut segments} + \text{total length of perforations}} \times 100$$

wherein the length of each uncut segment is the shortest distance along the tipping wrapper between adjacent perforations, and wherein the length of each perforation is the length of a straight line drawn between the two circumferential extremities of the perforation. In the case of a circular perforation, the length of the perforation is the diameter of the circle.

A high percentage of hold therefore represents a row of perforations in which a large amount of uncut material remains between the perforations. A row of perforations that has a high percentage of hold will generally require more force to break the tipping wrapper along the row of perforations.

Advantageously, a percentage of hold of between 15 percent and 30 percent is large enough to prevent accidental breakage of the tipping wrapper along the row of perforations when the tipping wrapper is handled during manufacture of the smoking article, while remaining low enough so that only a moderate breaking force is required to intentionally break the wrapper along the row of perforations after the smoking article has been constructed. It has been found that the force required to break a wrapper along a row of perforations defining a percentage of hold within this range is largely independent of the basis weight of the sheet material used to form the tipping wrapper when comparing different sheet materials that are typically used to form wrappers for smoking articles.

The row of perforations may optionally be provided with one or more additional features as described in EP-A-2 888 958.

In any of the embodiments described above, the aerosol generating article may be free from adhesive between the removable tipping wrapper portion and the underlying filter component, to facilitate removal of the removable tipping wrapper portion. Alternatively, the aerosol generating article may comprise a low-tack adhesive between the removable tipping wrapper portion and the underlying filter component.

The tipping wrapper is preferably formed of a sheet of paper material, although other materials would also be suitable. Preferably, the tipping wrapper is formed of a sheet material having a basis weight of between about 35 grams per square metre and about 50 grams per square metre.

The longitudinal edge of the tipping wrapper extending along the outer surface of the aerosol generating article may be substantially straight. However, in alternative embodiments of the present invention, the first longitudinal edge of the tipping wrapper comprises a tipping wrapper projection defining a tear tab downstream of the first weakening line, wherein the tear tab is free from adhesive.

As used herein, the term "tipping wrapper projection" refers to the portion of the first longitudinal edge which projects away from the remaining portion or portions of the edge in the circumferential direction to define a tear tab at the edge of the tipping wrapper. The tear tab is provided in the removable tipping wrapper portion, downstream of the first weakening line and may facilitate the grasping of the edge of the tipping wrapper by the consumer. The tear tab also provides a visual indication to the consumer of the position of the removable tipping wrapper portion and where the edge of the tipping wrapper should be grasped.

Preferably, a first straight line portion is provided in the first longitudinal edge, extending upstream from the tipping wrapper projection. The "first straight line portion" of the first longitudinal edge of the tipping wrapper extends in a straight line without curvature, substantially parallel to the longitudinal axis of the aerosol generating article.

Preferably, the tipping wrapper projection extends between about 2 mm and about 3 mm beyond the first straight line portion in the circumferential direction, more preferably between about 2 mm and about 2.5 mm. This corresponds to the circumferential distance between the first straight line portion and the "top" of the tipping wrapper projection where the height is greatest, which defines the height of the tear tab relative to the straight part of the longitudinal edge.

By providing a tear tab with a height of at least 2 mm, the tear tab is of a convenient size for the consumer to grasp. On the other hand, keeping the height of the tear tab less than or equal to 3 mm is typically preferred from a manufacturing point of view as it is more difficult to cut larger tear tabs at high speed using conventional cutting knives.

Preferably, the width of the tipping wrapper projection in the longitudinal direction is at least about 2.5 mm. Alternatively or in addition, the width of the tipping wrapper projection in the longitudinal direction is less than 15 mm. The "width" of the tipping wrapper projection corresponds to the maximum dimension of the tipping wrapper projection in the longitudinal direction.

The position of the tipping wrapper projection relative to the first weakening line may be varied, for example, in order to minimise the risk of tearing of the tipping wrapper other than along the first weakening line. Preferably, the tipping wrapper projection is provided between about 0 mm and about 15 mm downstream of the first weakening line, more preferably between about 5 mm and about 10 mm. This corresponds to the distance between the first weakening line and the upstream end of the tipping wrapper projection.

In certain embodiments of the invention, aerosol generating articles may comprise a tipping wrapper that is water impermeable or hydrophobic such that the tipping wrapper repels water from the filter. In such embodiments, the tipping wrapper acts as a barrier to protect the underlying water dispersible filter component from ambient moisture prior to use such that the integrity of the filter materials can be retained. However, after the aerosol generating article has been used, this type of tipping wrapper inhibits the contact between the underlying water dispersible filter component and environmental water to an even greater extent. The improvement in the water dispersibility of the filter component as a result of the removal of a portion of the tipping wrapper is therefore even more significant.

The term "hydrophobic" refers to a surface exhibiting water repelling properties. In the context of the present invention, a hydrophobic tipping wrapper provides at least one of a hydrophobic inner surface and a hydrophobic outer surface. One useful way to determine the hydrophobicity is to measure the water contact angle, as described in more detail below. The "water contact angle" is the angle, conventionally measured through the liquid, where a liquid/vapour interface meets a solid surface. It quantifies the wettability of a solid surface by a liquid via the Young equation.

Preferably, the hydrophobic surface of tipping wrapper of aerosol generating articles according to the present invention has a water contact angle of at least about 80 degrees, more preferably at least about 90 degrees, more preferably at least about 95 degrees, more preferably at least about 100 degrees. Hydrophobicity is determined by utilising the TAPPI T558 om-97 test and the result is presented as an interfacial contact angle and reported in "degrees", which can range from near zero degrees to near 180 degrees.

The tipping wrapper may be formed of any suitable hydrophobic material. Preferably, the tipping wrapper is coated or printed with a hydrophobic material on at least one surface. Suitable hydrophobic tipping wrappers are described in WO-A-2016/063182, which also provides details of the test method of TAPPI T558 om-97 referred to above. In certain embodiments, the tipping wrapper may be coated with a lip-release lacquer coating such as nitro cellulose or ethyl cellulose.

Alternatively or in addition to providing a hydrophobic tipping wrapper as defined above, the tipping wrapper may provide a wet tensile strength of at least about 2 Newtons per 15 millimetres when measured according to a wet tensile strength test, more preferably at least about 2.5 Newtons per 15 millimetres, more preferably at least about 3 Newtons per 15 millimetres and most preferably at least about 3.5 Newtons per 15 millimetres. The wet tensile strength test is identical to the test method of ISO 1924-2 except for the dipping of the test sample in 2 millilitres of liquid for 3 seconds, after conditioning for at least 24 hours at 22±2 degrees Celsius and 60±5% relative humidity and after cutting the test sample to size. The test sample is dipped in the liquid immediately prior to the pulling step of the test procedure.

Such a tipping wrapper provides a relatively high wet tensile strength, which means that the tipping wrapper is more likely to retain its structure when the filter comes into contact with moisture. The tipping wrapper can therefore continue to act as an effective barrier that prevents atmospheric moisture from penetrating into the water dispersible filter component prior to use, so that the filter materials are protected. However, after the aerosol generating article has been used, the tipping wrapper of such embodiments will take longer to physically break down and this will slow down any contact between the underlying water dispersible filter component and environmental water. The improvement in the water dispersibility of the filter component as a result of the removal of a portion of the tipping wrapper is therefore even more significant.

Suitable tipping wrappers are described in WO-A-2016/156219, which also provides details of the ISO 1924-2 test method referred to above.

The outer surface of the filter wrapper may be provided with text or graphics that are revealed to the consumer when the removable tipping wrapper portion is removed by the consumer during use. For example, the outer surface of the filter wrapper may be printed with inks to provide an aesthetic feature underneath the removable tipping wrapper portion.

In certain embodiments of the invention, at least one flavourant may be provided between the removable tipping wrapper portion and the underlying filter portion. As used herein, the term "flavourant" is used to describe a material that can be used to deliver at least one of a gustatory sensation and an olfactory sensation to the consumer. By providing a flavourant underneath the removable tipping wrapper portion, a consumer is provided with control over when the flavourant is delivered. Suitable flavourants for incorporation into aerosol generating articles would be known to the skilled person.

The at least one flavourant may be provided on a surface of the removable tipping wrapper portion facing the underlying filter portion, on the surface of the underlying filter portion, or both. The at least one flavourant may be deposited as a coating, or may be impregnated into the surface of the removable tipping wrapper portion or filter portion. The at least one flavourant may be encapsulated, for example, contained within a plurality of microcapsules, to reduce or prevent migration of the flavourant.

Alternatively or in addition to the provision of a flavourant between the removable tipping wrapper portion and the underlying filter portion, the filter may comprise at least one surface formation underlying the removable tipping wrapper portion. As used herein, the term "surface formation" describes a variation in a surface of the filter that results in the surface being non-uniform. By providing at least one surface formation on the surface of the filter underlying the removable tipping wrapper portion, a consumer is provided with a choice over the surface texture of the aerosol generating article that contacts their lips during smoking or otherwise using the aerosol generating article.

The filter may comprise a filter wrapper, as described above, wherein the filter wrapper comprises the at least one surface formation. The at least one surface formation may comprise at least one of an embossment and a debossment. Alternatively or in addition, the at least one surface formation may comprise a variation in the thickness of the filter wrapper. Alternatively or in addition, the at least one surface formation may comprise one or more materials deposited or otherwise provided on a surface of the filter wrapper, for example, at least one of an ink or varnish.

Aerosol generating articles according to the present invention may be filter cigarettes or other smoking articles in which the aerosol generating substrate comprises a tobacco material that is combusted to form smoke. Therefore, in any of the embodiments described above, the aerosol generating substrate may comprise a tobacco rod.

Alternatively, aerosol generating articles according to the present invention may be articles in which a tobacco material is heated to form an aerosol, rather than combusted. In one type of heated aerosol generating article, a tobacco material is heated by one or more electrical heating elements to produce an aerosol. In another type of heated aerosol generating article, an aerosol is produced by the transfer of heat from a combustible or chemical heat source to a physically separate tobacco material, which may be located within, around or downstream of the heat source. The present invention further encompasses aerosol generating articles in which a nicotine-containing aerosol is generated from a tobacco material, tobacco extract, or other nicotine source, without combustion, and in some cases without heating, for example through a chemical reaction.

The invention will now be further described, by way of example only, with reference to the accompanying drawing in which:

FIG. 1 shows an aerosol generating article in accordance with a first embodiment of the present invention.

The aerosol generating article 10 shown in FIG. 1 is a filter cigarette comprising an aerosol-generating substrate 12 in the form of a wrapped tobacco rod and a filter 14 comprising a single filter segment 16 axially aligned with the tobacco rod. A downstream end of the tobacco rod abuts an upstream end of the filter 14 along the line 18 shown in FIG. 1.

The filter segment 16 comprises a plug formed of a gathered water dispersible sheet material comprising cellulose fibres, cellulose acetate fibres and an alkali metal salt of carboxymethyl cellulose (CMC). The plug is circumscribed by a water dispersible plug wrap formed of a sheet material comprising wood pulp and carboxymethyl cellulose (CMC). The filter segment 16 as a whole, with the plug wrap in place, is water dispersible according to the test method of EN 14987, as described above.

A tipping wrapper 20 comprising a row of perforations that form a weakening line 22 is wrapped around the filter 14 and a portion of the tobacco rod so that an upstream tipping wrapper portion 24 extends upstream from the weakening line 22, and a removable tipping wrapper portion 26 extends downstream from the weakening line 22. Only the upstream tipping wrapper portion 24 is glued to the underlying portions of the tobacco rod and the filter 14. The removable tipping wrapper portion 26 is not glued to the underlying filter 14 and is secured to the aerosol generating article 10 only along the weakening line 22 where it is secured to the upstream tipping wrapper portion 24.

The longitudinal edge 28 of the tipping wrapper 20 forms a seam extending in a longitudinal direction along the filter 14. A curved tear tab 30 is provided at the longitudinal edge 28, at a distance downstream of the first weakening line 22.

Before, during or after smoking the aerosol generating article 10, the consumer can remove the removable tipping wrapper portion 26, if desired, to expose the underlying filter segment 36. To remove the removable tipping wrapper portion 26 the consumer can grasp the tear tab 30 on the removable tipping wrapper portion 26 and can then peel the removable tipping wrapper portion 26 away from the filter 14 by breaking the row of perforations forming the weakening line 22.

The removal of the removable tipping wrapper portion 26 in this way exposes the underlying portion of the filter segment 16 so that after the filter has been discarded, the filter segment can more readily come into contact with environmental water. The speed at which the filter segment 16 disperses in water is therefore significantly increased due to the removal of the removable tipping wrapper portion 26. Upon contact with environmental water, the water dispersible plug wrap will initially breakdown, which will in turn expose the underlying plug of water dispersible sheet material to come into contact with water and disperse. This effect of the water dispersible filter segment 16 in combination with an removable tipping wrapper portion 26 is demonstrated in the example below.

EXAMPLE

The following test to measure degradability of a filter in soil is conducted on a sample of 10 of each of the cigarettes below:

Cigarette A: A cigarette having a conventional cellulose acetate tow

Cigarette B: A cigarette according to the present invention as shown in FIG. 1 and described above, with the removable tipping wrapper portion intact Cigarette C: A cigarette according to the present invention as shown in FIG. 1 and described above, with the removable tipping wrapper portion removed For each sample, the cigarettes are smoked and any remaining tobacco is removed from the filters. The filters are conditioned for 3 hours at 105 degrees Centigrade and subsequently for 48 hours at about 22 degrees Centigrade and about 60 percent relative humidity. The samples are then weighed to provide an initial weight (t=0), placed in a container of soil, covered by a metallic net and then left outside.

After 6 months, the samples are removed from the soil, cleaned and then conditioned as described above before being weighed (t=6 m). The samples are then returned to the soil for a further 6 months before being removed, cleaned and weighed again (t=12 m).

A comparison of the weight of each sample at t=6 months and t=12 months relative to the starting weight at t=0 is shown in the table below:

| | Cigarette A | | Cigarette B | | Cigarette C | |
|---|---|---|---|---|---|---|
| Time | % Weight | % Weight loss | % Weight | % Weight loss | % Weight | % Weight loss |
| t = 0 | 100 | 0 | 100 | 0 | 100 | 0 |
| t = 6 m | 83 | 17 | 84 | 16 | 68 | 32 |
| t = 12 m | 81 | 19 | 69 | 31 | 45 | 55 |

The results in the table above can be used to provide a comparison between the rate of degradability in soil of a conventional filter comprising a plug of cellulose acetate tow and a filter of a smoking article according to the invention. The higher the percentage weight loss, the more the filter has degraded during the test period and therefore the higher the rate of degradability.

It can be seen that for the filters of the cigarettes according to the invention, Cigarettes B and C, the weight of the filter is reduced by over 30 percent over the 12 month test period compared with only 19 percent for the conventional filter from Cigarette A.

When the removable tipping wrapper portion is removed prior to the test, as for the filter of Cigarette C, it can be seen that the percentage weight loss increases significantly to above 50 percent. This clearly demonstrates the advantageous effect that the combination of the water dispersible filter component and the removable tipping wrapper portion provide on the rate of degradation of the filter. In particular, it can be seen that such a combination significantly increases the rate of degradation of the filter compared to the conventional filter.

The invention claimed is:

1. An aerosol generating article comprising:

an aerosol generating substrate;

a filter in axial alignment with the aerosol generating substrate, the filter comprising at least one water dispersible filter component, wherein the filter component is water dispersible under the test conditions of EN14987:2006; and a tipping wrapper wrapped around the filter and at least a portion of the aerosol generating substrate, the tipping wrapper comprising:

a first weakening line extending around at least a portion of the tipping wrapper;

a removable tipping wrapper portion extending downstream from the at least one weakening line and at least partially overlying the water dispersible filter component; and an upstream tipping wrapper portion extending upstream from the first weakening line, wherein the upstream tipping wrapper portion is attached to a downstream portion of the aerosol generating substrate and an upstream portion of the filter, wherein the removal of the removable tipping wrapper portion at least partially exposes the underlying water dispersible filter component.

2. The aerosol generating article according to claim 1 wherein the at least one water dispersible filter component is formed of a water dispersible sheet material.

3. The aerosol generating article according to claim 2 wherein the at least one water dispersible filter component comprises a plug formed of the water dispersible sheet material.

4. The aerosol generating article according claim 2 wherein the at least one water dispersible filter component comprises a wrapper formed of a water dispersible sheet material which circumscribes at least a portion of the filter.

5. The aerosol generating article according to claim 2 wherein the water dispersible sheet material comprises cellulosic fibres and a water soluble binder.

6. The aerosol generating article according to claim 5 wherein the cellulosic fibres comprise wood pulp fibres, cellulose acetate fibres or combinations thereof.

7. The aerosol generating article according to claim 6 wherein the cellulosic fibres comprise wood pulp fibres and cellulose acetate fibres in a ratio of between 40:60 and 70:30.

8. The aerosol generating article according to claim 5 wherein the water soluble binder comprises carboxymethyl cellulose (CMC), or a salt or a derivative of CMC.

9. The aerosol generating article according to claim 5 wherein the water soluble binder comprises an alkali metal salt of an anionic polymer.

10. The aerosol generating article according to claim 1 wherein the at least one water dispersible filter component comprises a fibrous tow segment formed of a plurality of fibres combined with a water soluble binder.

11. The aerosol generating article according to claim 1 wherein the at least one water dispersible filter component has a biodegradability in soil medium of at least 45 percent.

12. The aerosol generating article according to claim 1 wherein the at least one water dispersible filter component has a biodegradability in aqueous medium of at least 45 percent.

13. The aerosol generating article according to claim 1 wherein the tipping wrapper has a water contact angle of at least 80 degrees.

14. The aerosol generating article according to claim 12 wherein the tipping wrapper comprises a hydrophobic coating layer on the outer surface.

15. The aerosol generating article according to claim 1 wherein the tipping wrapper has a wet tensile strength of at least 2 Newtons per 15 millimetres when measured according to ISO 1924-2 except for the dipping of a test sample in 2 millilitres of liquid for 3 seconds, after conditioning for at least 24 hours at 22±2 degrees Celsius and 60±5% relative humidity and after cutting the test sample to size.

16. The aerosol generating article according to claim 7, wherein the cellulosic fibres comprise wood pulp fibres and cellulose acetate fibres in a ratio of 50:50.

* * * * *